US005857635A

United States Patent [19]

Klippert

[11] Patent Number: 5,857,635

[45] Date of Patent: Jan. 12, 1999

[54] CABLE DRUM FOR A CABLE DRIVEN APPARATUS

[75] Inventor: Uwe Klippert, Oberaula, Germany

[73] Assignee: Brose Fahrzeugteile GmbH & Co. KG, Coburg, Germany

[21] Appl. No.: 831,837

[22] Filed: Apr. 2, 1997

Related U.S. Application Data

[63] Continuation of Ser. No. 253,974, Jun. 3, 1994, abandoned.

[30] Foreign Application Priority Data

Jun. 4, 1993 [DE] Germany ..... 43 18 591.6
Mar. 13, 1994 [DE] Germany ..... 44 16 979.5

[51] Int. Cl.[6] ..... B65H 75/18; B65H 75/24; B65H 19/24; E05F 11/48

[52] U.S. Cl. ..... 242/407; 242/571.4; 242/579; 242/587.1; 242/125.1; 242/613; 49/352

[58] Field of Search ..... 242/407, 579, 242/571.4, 587.1, 125.1, 613; 49/352

[56] References Cited

U.S. PATENT DOCUMENTS

| | | | |
|---|---|---|---|
| 1,984,604 | 12/1934 | Stahl | 242/581.1 X |
| 2,946,562 | 7/1960 | Handley | 242/587.1 X |
| 3,550,872 | 12/1970 | Porterfield | 242/613 |
| 3,779,476 | 12/1973 | Hofbauer | 242/571.4 X |
| 4,428,542 | 1/1984 | Kobayashi et al. | 242/54 R |
| 4,440,354 | 4/1984 | Kobayashi et al. | 242/54 R |
| 4,547,993 | 10/1985 | Kobayashi et al. | 49/352 |
| 4,657,523 | 4/1987 | Chevance et al. | 49/352 X |
| 4,813,304 | 3/1989 | Kobayashi | 74/501.5 R |
| 4,941,286 | 7/1990 | Marscholl et al. | 49/359 |
| 5,047,077 | 9/1991 | McMaster et al. | 65/349 |
| 5,074,077 | 12/1991 | Toyoshima et al. | 49/352 |

FOREIGN PATENT DOCUMENTS

| | | |
|---|---|---|
| 2215222 | 12/1972 | Germany . |
| 3145277 | 1/1983 | Germany . |
| 3204195 | 2/1983 | Germany . |
| 3153064 | 1/1984 | Germany . |
| 3146092 | 7/1993 | Germany . |
| 3-72552 | 10/1963 | Japan . |
| 63-372552B | 2/1988 | Japan . |
| 82 8215 | 11/1982 | South Africa . |
| 82 8351 | 11/1982 | South Africa . |
| 1382330 | 1/1975 | United Kingdom . |

*Primary Examiner*—John Q. Nguyen
*Attorney, Agent, or Firm*—Christie, Parker & Hale, LLP

[57] ABSTRACT

A cable drum assembly comprises a cable drum for a cable-driven apparatus such as a cable window lifter, in particular of a motor vehicle, which automatically compensates for cable slackness without deforming the window lift system. The cable drum has the advantage that it only removes the so-called genuine cable slackness present when the window lifter is in the relaxed state. The cable drum has a part for compensating the cable slackness which can be moved in relation to the outer cable drum wall and is disposed in a guide inside the cable drum. The part may be connected with one cable end of the cable loop, and that when a load is placed on the cable drum by the cable, the part is arrested on the cable drum. When the cable drum is unloaded, a spring urges the part so as to take up cable slackness. In other embodiments, the part presses against the outer cable drum wall and irreversibly increased its diameter when it is unloaded or rotates with respect to the cable drum and winds in slack cable when the drum is unloaded.

24 Claims, 9 Drawing Sheets

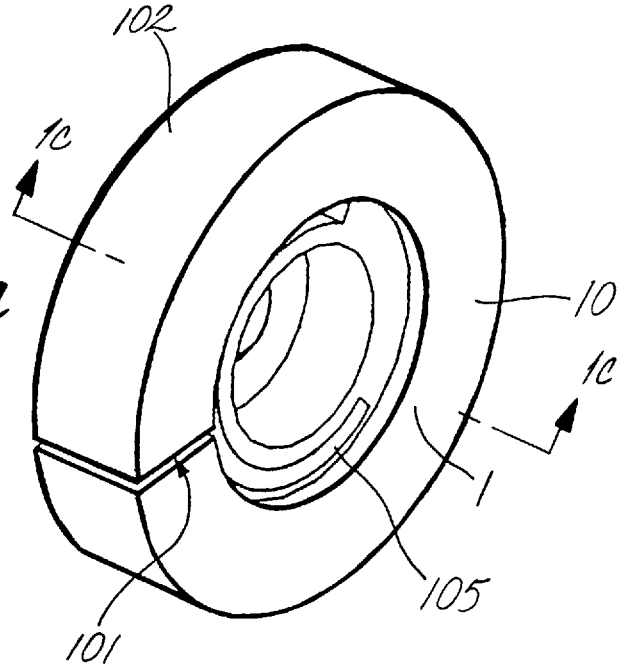
Fig. 1a
Fig. 1b
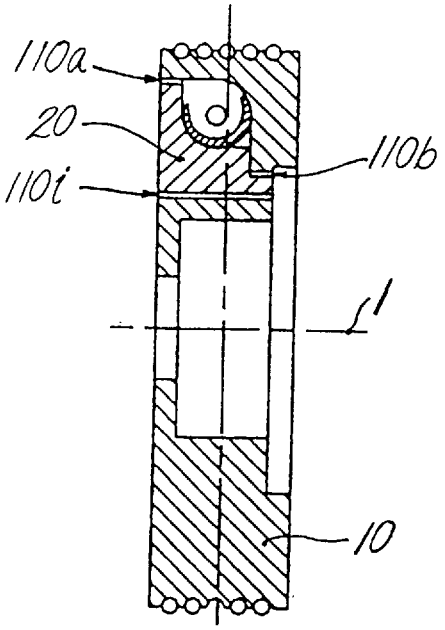
Fig. 1c
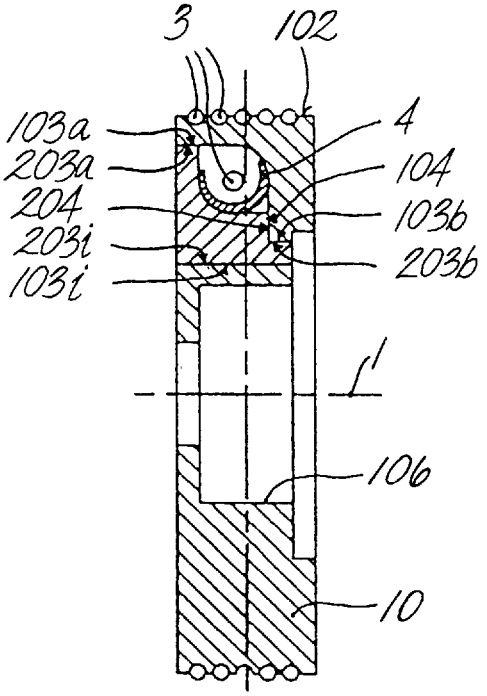

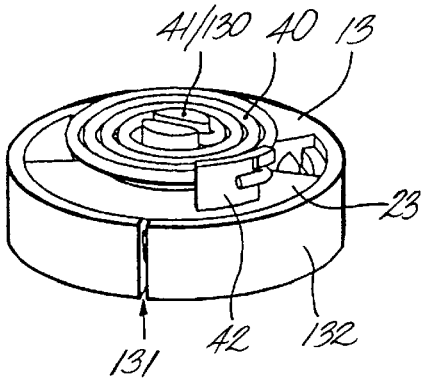
Fig. 5a
Fig. 6a
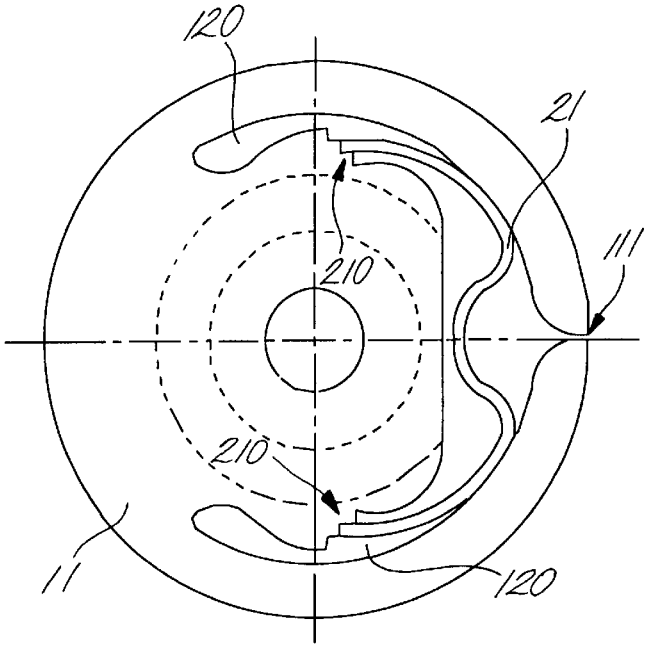
Fig. 5b
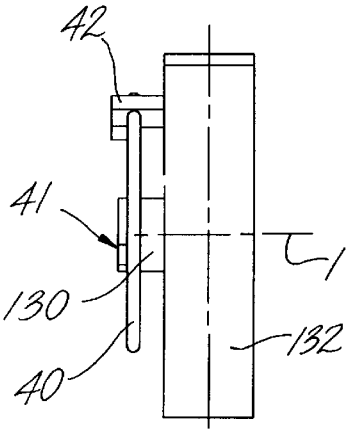
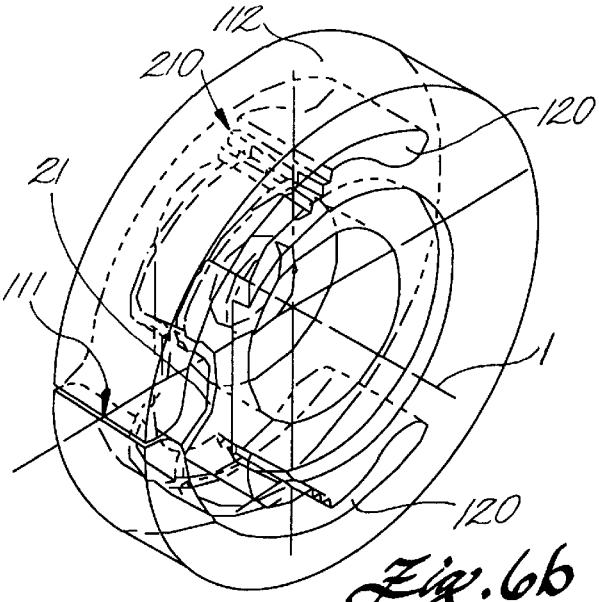
Fig. 6b

CABLE DRUM FOR A CABLE DRIVEN APPARATUS

CROSS-REFERENCE TO RELATED APPLICATION

This is a continuation of application Ser. No. 08/253,974, filed Jun. 3, 1994, abandoned.

FIELD OF THE INVENTION

The invention relates to a cable drum for a cable-driven apparatus such as a cable window lifter for motor vehicles, which automatically compensates for occurring cable slackness without deforming the cable-driven apparatus. The cable drum has an advantage in that it only removes the so-called genuine cable slackness present when the cable-driven apparatus is in a relaxed state.

BACKGROUND OF THE INVENTION

A drive device for a cable window lifter is described in German Patent Publication DE 31 45 277 C2, in which the cable drum comprises a first half for winding up the one cable end and a second half for winding up the other cable end. Ratchet teeth, which are in engagement with each other, are provided on the fronts of the cable drum halves facing each other. A spring presses the cable drum halves together and ensures that they turn in respect to each other but only after a defined difference in the transferable torque has been attained. For this purpose the first drum half is connected and fixed against relative rotation with the shaft of the drive, while the second drum half can be displaced on a cylindrical journal against the spring force in an axially limited manner and can then be turned in a circumferential direction.

The disadvantage of this device lies in that not only the so-called genuine cable slackness of a "relaxed" window lifter is compensated, wherein the drive moves over an appropriate dead angle making the typical ratcheting noise, but that an overload slackness is also removed. Such overload slackness can occur when the window lifter is moved against a stop with great force and the system becomes greatly deformed. Because the deformation is maintained, almost all components of the window lifter are put under heavy loads, which results in accelerated material fatigue and can even lead to system breakdowns.

A further device for compensating the length of the cable is described in Japanese Patent Publication JP 3-72552 B2. In accordance therewith, one of the Bowden tube supports of the window lifter is seated on the base plate supporting the cable drum so it is resilient in the direction of the cable. In this case the Bowden tube end comprises two parts in the area of the support which can be screwed together and through which the cable is guided. Both parts are loaded by a pressure spring which attempts to push the two parts, which can be screwed together, away from each other. The screw thread is embodied in such a way that, if cable slackness occurs, the two parts are unscrewed by the effect of the pressure spring until the cable is taut again. In the opposite direction detent teeth on the one screwable part, which are engaged with the end of the pressure spring embodied as a coil spring, prevent the two parts from entering each other. However, the above-described solution also has the disadvantage that it also removes cable slackness caused by an overload on the window lifter from the drive end, which results in a deformation of the mechanical system. A further disadvantage resides in that the proposed solution is only usable in connection with Bowden window lifters. This solution cannot be used in so-called open cable systems.

SUMMARY OF THE INVENTION

It is an object of the invention to provide a cable drum for a cable-driven apparatus, such as a cable window lifter, which ensures an automatic and, in particular, continuous compensation of cable slackness.

It is a further object of the invention to provide a cable drum which can be made from only a few parts that can be produced cost-effectively and are easy to manipulate.

It is another object of the invention to provide a cable drum which compensates only for so-called "genuine" cable slackness for when the cable-driven apparatus such as a window lifter is not loaded and will avoid deformation of the cable-driven apparatus because of the removal of overload slackness.

Yet another object of the invention is to provide a cable driver which compensates for manufacturing tolerances in the cable used which occurred during the installation process of the associated cable-driver apparatus.

The above objects are attained in accordance with the invention by a cable drum having a part which is movable in relation to the outer cable drum wall. This part is disposed inside the cable drum or below the outer wall of the cable drum. The movable part may be connected with one cable end, wherein the cable extends from its point of attachment on the movable part to the exterior of the outer cable drum wall (i.e., the winding surface of the cable drum)

In a first embodiment of the invention, a spring is used for compensating for cable slackness. The spring acts on a part which is movable in relation to the outer cable drum wall, wherein this movable part, together with the cable end attached to it, is displaced until the cable slackness has been compensated.

In a second embodiment of the invention, the winding force (driving force of the window lifter) is used to compensate the cable slackness, wherein the part which is movable in relation to the outer cable drum wall is connected with the driveshaft in such a manner that it is fixed against relative rotation. A section of the movable part located in the interior of the cable drum acts as a winding element for winding-up whatever cable slackness occurs. The frictional and interlocking connection provided between the cable drum and the part which is movable in relation to it ensures a drive free of slippage opposite the direction of turning.

The invention, in a variation on the first-mentioned embodiment, provides a cable drum having a guide for a slide, in which the slide can make a regulating movement for compensating for the cable slackness. In this connection the cable drum wall is radially movable in a limited way, and can come into clamping or arresting engagement with the slide in such a way that a displacement of the slide and therefore the compensation of the cable slackness only takes place if there is a lack of radial forces on the cable drum, which will happen when the cable-driven apparatus is not loaded (is relaxed).

Another version of the first mentioned embodiment provides a cable attachment in the slide which is displaceable in relation to the other cable attachment, by means of which the compensation of the cable is ensured. The slide movement can be caused by a prestressed spring element acting on the slide and supported on the opposite surface of the cable drum.

If a slide attached to a cable end is used, it is advantageous to dispose the slide in a conduit which extends concentrically in the cable drum. In order to ensure force-locking or interlocking arrest of the slide (for example by means of micro-toothing) by the cable when the cable drum is put under radial load, the cable drum may have at least one radially extending slit. This slit ensures the radial mobility of the outer wall of the cable drum, which is necessary for arresting the slide. When the cable comes under a load, the slide is wedged in its conduit-like extending guide. However, if a cable slackness occurs, a spring, one end of which is supported on the cable drum and the other on the slide, ensures that the cable slackness is removed by means of a corresponding relative movement between the two.

Another embodiment employs a slide which presses against the outer cable drum wall and which executes a radial, outwardly directed cable movement when the cable drum is not loaded, i.e., when radial forces are not present, which results in a quasi-increase of the diameter of the cable drum wall.

Under different spatial conditions, an appropriate slide can also be disposed in an axially oriented guide and can ensure the removal of the cable slackness by analogous axial displacement movements.

In accordance with another embodiment of the invention, the slide does not have a direct connection with the cable end and therefore cannot have a direct effect on the removal of the cable slackness. Instead, the regulating movement of the slide, also caused by a spring force, results in an increase of the diameter of the cable drum, which may be radially slit. Wedge-shaped (sliding) slides or those that can be arrested in steps can be used for this purpose.

However, it must be ensured in every case that the restoring movements of the slide are prevented.

The invention, in a variation on the second mentioned embodiment, provides interlocking elements on the jacket surface of the movable part that acts as a winding element for winding up whatever cable slackness occurs. The interlocking elements can be brought into engagement with locking elements of the oppositely located inner jacket surface of the cable drum. This is achieved by means of the limited radial inward movement of the cable drum wall because of the pressure which the tensioned cable exerts on the cable drum wall when cable slackness is no longer present. To ensure the radial movement, the cable drum wall has a slit, as already mentioned above. Alternatively, however, the use of unslitted, but sufficiently flexible cable drum walls is also possible when radial flexibility is needed to arrest the relative movement of the movable part with respect to the cable drum.

However, axially oriented toothed elements can also be used if a spring puts an axially-directed load on respective toothed elements of the drum and rotatable part, which are movable in respect to each other. A slit in the cable drum wall, which would assure limited radial mobility, is not necessary in this case.

The diameter of the winding element preferably is considerably less than the diameter of the cable drum. In this way the winding element can be easily disposed in the interior of the cable drum and can take up not only cable slackness which occurs, but can also compensate tolerances in the cable length or mounting tolerances.

The invention will be explained in detail below by means of exemplary embodiments as well as the drawing figures shown.

BRIEF DESCRIPTION OF THE PREFERRED EMBODIMENTS

FIG. 1 is a basic illustration of a single-cable window lifter;

FIG. 1*a* is a perspective view of a cable drum of the invention with a slide guided concentrically to the shaft of the cable drum;

FIG. 1*b* is a cross-sectional view of FIG. 1*a* with a cable slackness occurring and the cable drum relieved;

FIG. 1*c* shows the cross-sectional view of FIG. 1*b* with the cable drum loaded;

FIGS. 2*a*, 2*b*, and 2*c* are perspective representations of individual parts or components of the cable drum in accordance with FIG. 1, in which:

FIG. 2*a* shows a slide;

FIG. 2*b* shows a slide with an attached cable end; and

FIG. 2*c* is an exploded view of the cable drum;

FIGS. 3*a*, 3*b*, and 3*c* are representations of the cable drum of FIG. 1 in the initial position with the spring taut, in which:

FIG. 3*a* is a view of the cable drum of FIG. 1 with the slide (not in section);

FIG. 3*b* is a view of the cable drum of FIG. 1 without a slide;

FIG. 3*c* is a view of the cable drum of FIG. 1 with a slide (in section);

FIGS. 4*a*, 4*b*, and 4*c* are representations of the cable drum of FIG. 1 in the end position with the spring relaxed, in which:

FIG. 4*a* is a view of the cable drum of FIG. 1 with the slide (not in section);

FIG. 4*b* is a view of the cable drum of FIG. 1 without a slide; and

FIG. 4*c* is a view of the cable drum of FIG. 1 with a slide (in section);

FIG. 5*a* is a perspective view of the cable drum of the invention with a flat coil spring;

FIG. 5*b* is a lateral view of FIG. 5*a*;

FIG. 6*a* is a lateral view of FIG. 6*b*;

FIG. 6*b* is a perspective, see-through view of a cable drum of the invention with an arrestable slide and increasable circumference;

FIGS. 7*a*, 7*b*, and 7*c* are representations of a cable drum with increased circumference by means of spring-loaded wedge shaped slides, in which:

FIG. 7*a* is a representation of the position of the spring;

FIG. 7*b* is a representation of the position of the spring;

FIG. 7*c* is a representation of the position of the wedge-shaped slides; and FIG. 7*d* is a representation of the position of the wedge-shaped slides;

FIGS. 8*a*, 8*b*, and 8*c* show a cable drum with a slide which can be axially moved by spring force and to which a cable is attached, in which:

FIG. 8*a* is a perspective view of the cable drum from the direction of the drive;

FIG. 8*b* is a perspective view from the direction of the drive; and

FIG. 8*c* is a cross-sectional view of the cable drum;

FIGS. 9*a*, 9*b*, and 9*c* are basic representations of a cable drum with a rotatably seated winding element when there is cable slackness, in which:

FIG. 9*a* shows a cable drum with play between the inner cable drum wall and the winding element when there is cable slackness;

FIG. 9*b* shows a cable drum with friction or interlocking engagement between the cable drum and the winding element when the outer cable drum wall is loaded from the cable;

FIG. 9*c* shows the position, turned by approximately 90°, of the loaded cable drum;

FIG. 9*d* is a cross-sectional view of the cable drum; and

FIG. 9*e* is an enlarged representation of the portion of the toothed area between the cable drum and the winding element that is identified by "A" in FIG. 9*a*.

DETAILED DESCRIPTION OF THE PREFERRED EMBODIMENTS

Figure 1:
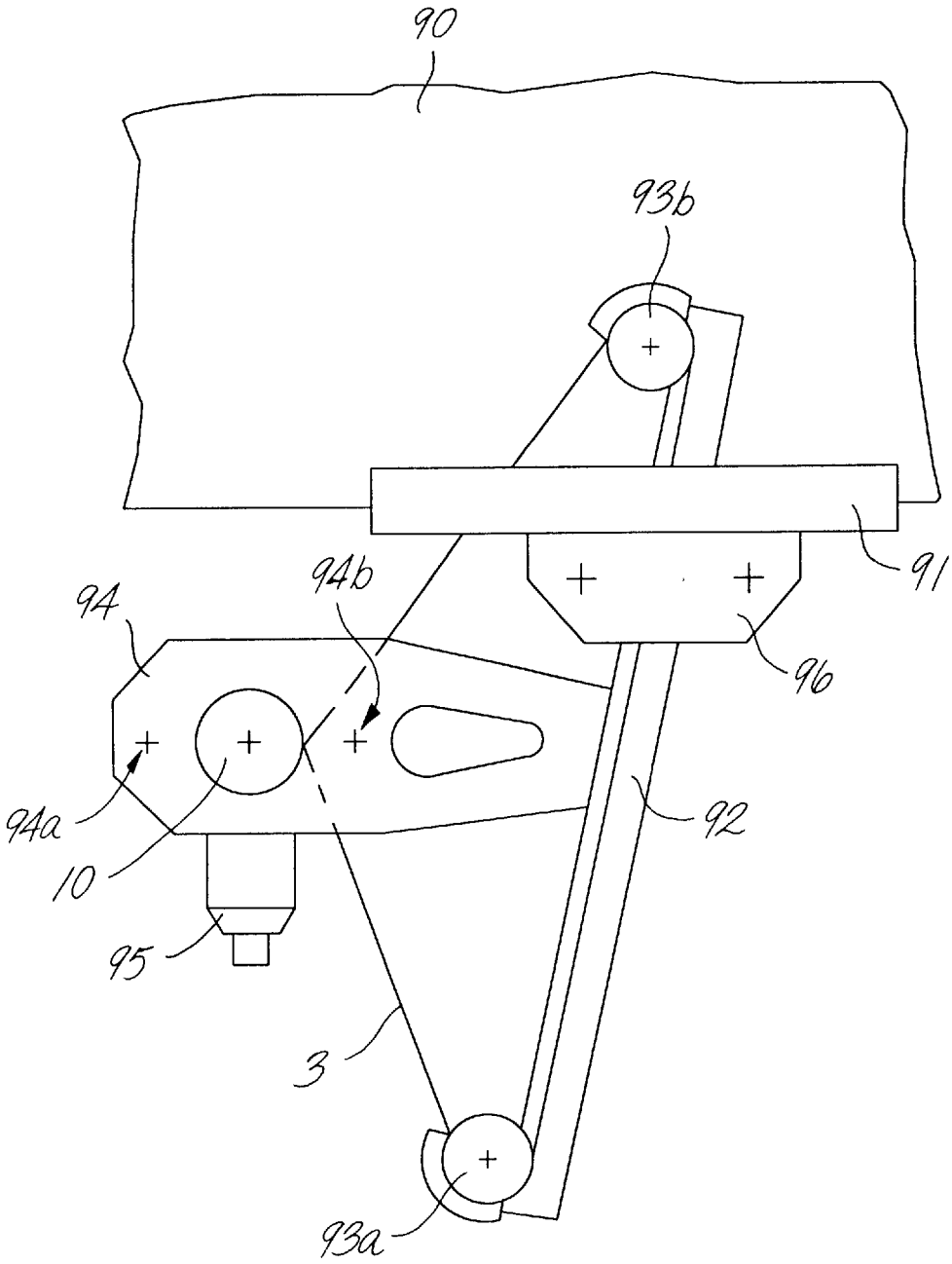

The basic structure of a single-cable window lifter can be seen in FIG. 1. A closed cable loop 3 is used to transfer the motive force supplied by, for example, a hand crank (not shown) or a motor 95 to lift and lower an object, in this case the window pane 90. The cable loop 3 is wound several times around the cable drum 10 and is guided around upper and lower cable reversing pulleys 93*a* and 93*b*. The cable reversing pulleys 93*a* and 93*b* are fastened to the ends of a guide rail 92, on which a catch 96 is displaceably seated and attached to the cable 3. The catch 96 is connected with a lifter rail 91, which in turn is fastened on the window pane 90. The cable window lifter is fastened in place by means of fastening positions 94*a* and 94*b* on a base plate 94. One end of the base plate 94 supports the motor 95 and the cable drum 10 and the other end is fixedly connected with the guide rail 92.

It is well known in the art of cable-driven apparatus employing closed cable loops to attach the ends of the cable to the cable drum or pulley. Arrangements of this sort are shown in U.S. Pat. Nos. 5,047,077, 4,813,304, and 4,547,993 as well as in German Patent Publications DE 22 15 222, DE 31 46 092 C2, DE 31 53 064 A1, and DE 32 04 195 C2. The disclosures of each of these U.S. and German patent documents is hereby incorporated by reference. Except as required to describe the invention, the means of attachment of the end of the cable 3 will not be discussed herein as these means are well known to those of skill in the art to which this invention pertains.

In the embodiment shown in FIGS. 1*a* to 4*c*, one end of the cable 3 is attached to a slide 20 rather than to the cable drum 10. The cable drum 10 has a conduit-like guide which extends concentrically to the axis 1 and receives the slide 20 (the guide may alternatively extend both concentrically and axially in a helical path) . The slide 20 has a spring support 42 (FIGS. 29-2*c*). The cable attachment chamber 5 is located on one side of the spring support 42 of the slide. Starting at the cable attachment or cable fitting 50, the cable 3 extends through the coil spring 4, which on the drum side rests against the spring support 41 of the cable drum, and is then passed through the bar 30. A cable conduit 31 ending at the outer cable drum wall 102 is connected to this bar 30 which terminates at the end of the concentric conduit.

The base body of the cable drum 10 has a radially and axially extending slit 101 which is intended to ensure the wedging of the slide 20 under load and in cooperation with various support and friction surfaces 103*a*, 103*b*, 103*i*, 203*a*, 203*b*, 203*i*.

The locations of the individual support or friction surfaces can easily be seen in FIGS. 1*b*, 1*c* and 2*a*, 2*b*, 2*c*. The surfaces 103*a*, 103*b* and 103*i* on the drum side are oppositely located to the surfaces 203*a*, 203*b* and 203*i* on the slide side. Gaps 110*a*, 110*b* or 110*i*, shown in a greatly exaggerated size, exist between the surface pairs 103*a*, 203*a* or 103*b*, 203*b* or 103*i*, 203*i* when the outer cable drum wall 102 is not put under a load by the cable 3 on account of a cable slackness (see FIG. 1*b*).

The coil spring 4 can become effective under these conditions and can tighten the cable 3 again by displacing the slide 20. As soon as a load is placed on the cable drum 10 (see FIG. 1*c*), a small, radial, inwardly directed movement of the outer cable drum wall 102 occurs in the area of the gap 101 of the cable drum as the circumference of the cable drum decreases. Because of this, the gaps 100*a*, 110*b* or 110*i* between the above-mentioned surface pairs of the support or friction surfaces are eliminated and the slide 20 is wedged in its position.

Figure 2A:
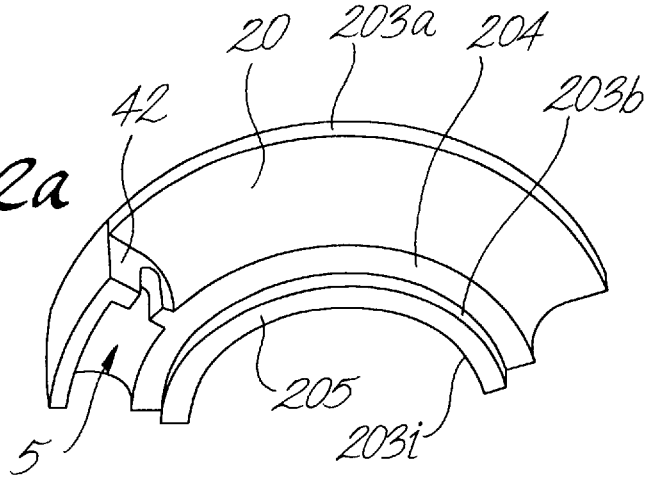
Figure 2B:
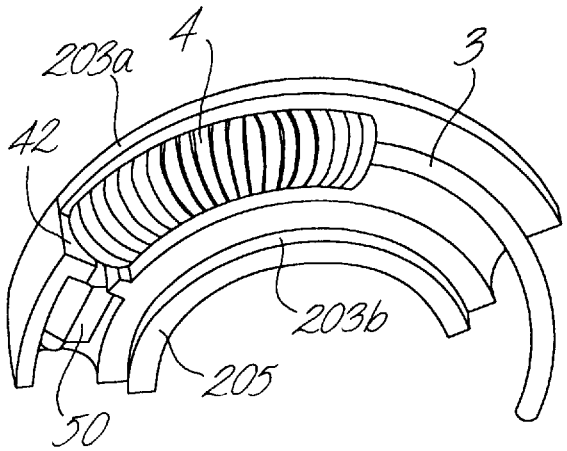
Figure 2C:
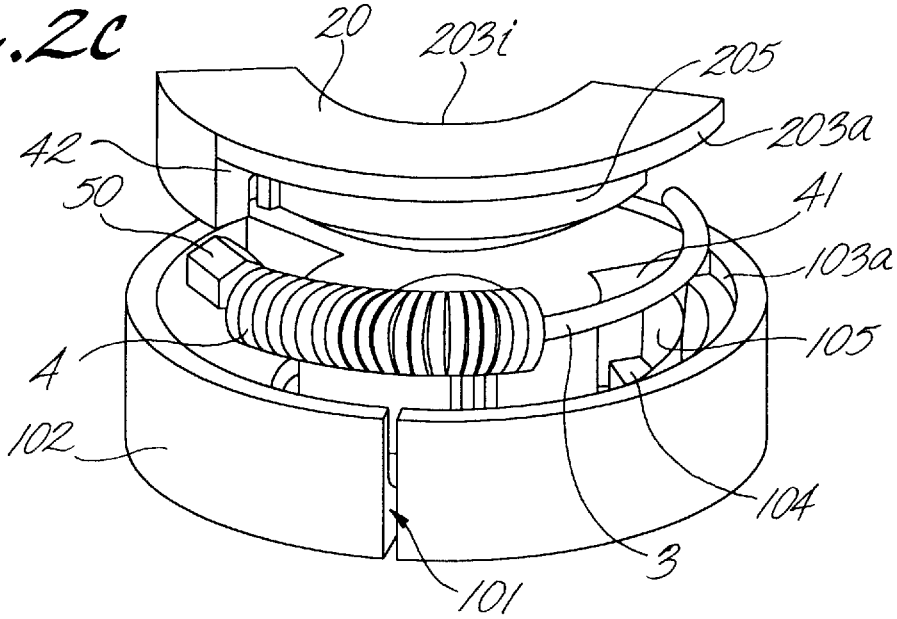

A clamping ring segment 205 is furthermore provided on the slide 20, which engages a matched clamping ring segment 105 of the cable drum 10 and is intended to lead to an increase of the wedging effect (FIG. 2*c*). Axially oriented support surfaces 104, 204 are also disposed in this area and fix the positions of the cable drum 10 and the slide 20 in the direction towards the axis 1.

To ensure satisfactory stable and dependable operation of the cable drum 10, the radially extending slit 101 should be covered by the slide 20 in its every possible position. It is of course possible to provide several slits 101, if required, and additional interlocking elements (for example micro-toothing) on the support surfaces 103*a*, 103*b*, 103*i* and 203*a*, 203*b*, 203*i*.

Figure 3C:
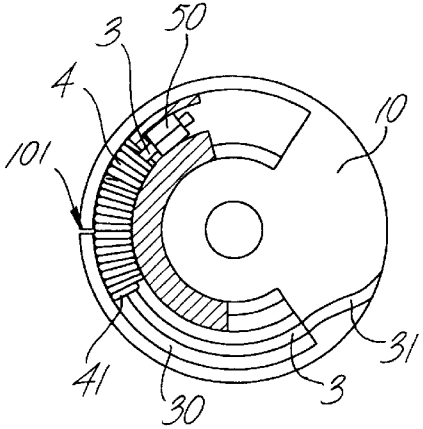
Figure 3B:
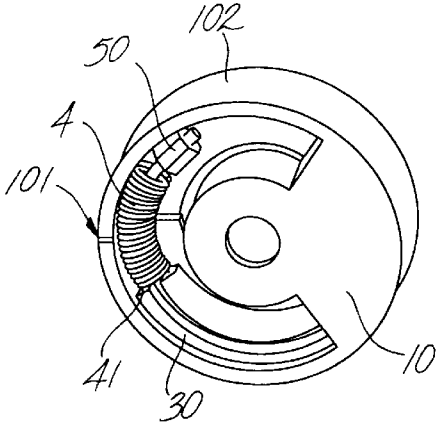
Figure 3A:
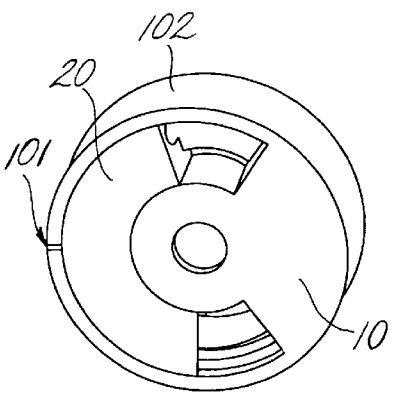
Figure 4C:
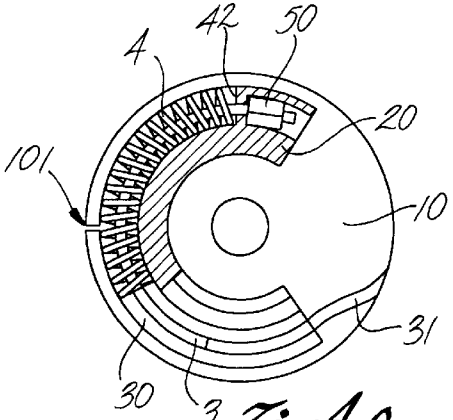
Figure 4B:
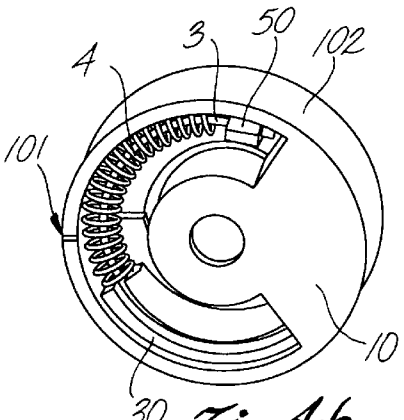
Figure 4A:
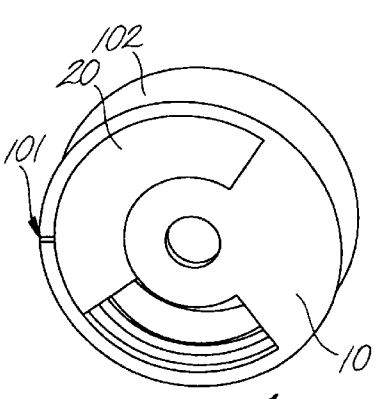
Figure 7A:
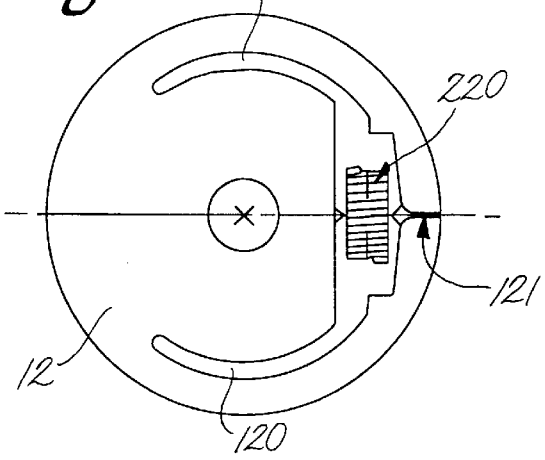
Figure 7C:
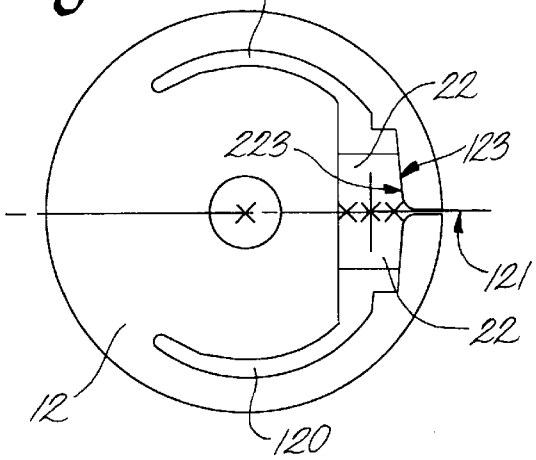
Figure 7B:
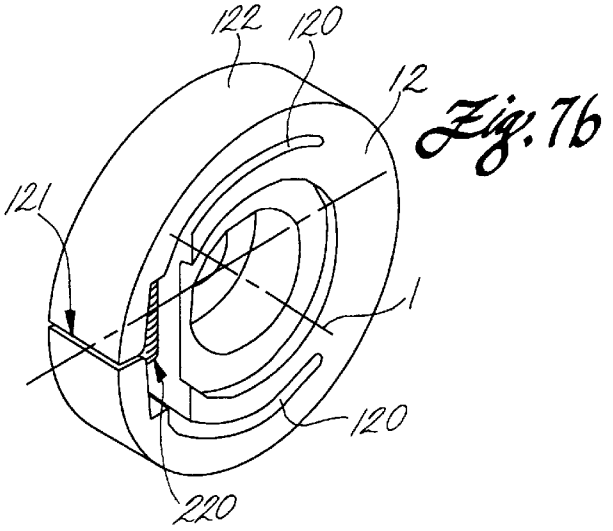
Figure 7D:
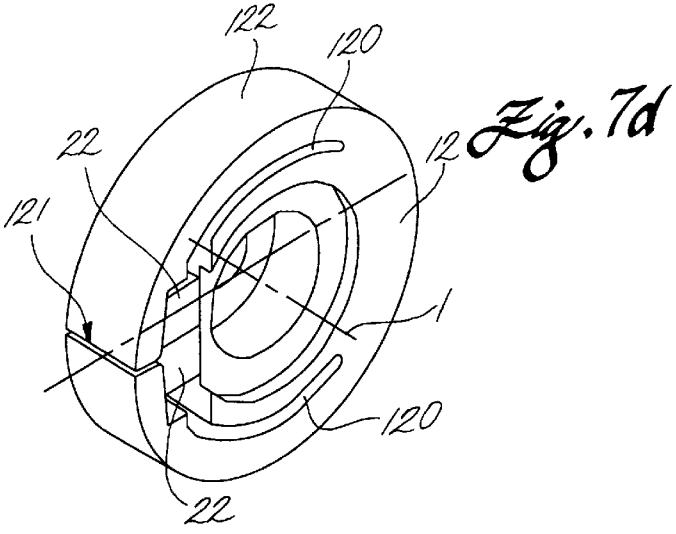

The two possible extreme positions of the slide 20 in its conduit-like guide are illustrated in FIGS. 3*a*–3*c* and FIGS. 4*a*–4*c*. FIGS. 3*a*–3*c* show the slide 20 in its initial position with a coil spring 4 compressed into a block and disposed between the supports 41, 42. After overcoming the existing displacement path, the slide 20 attains its stop or end position (see FIGS. 4*a*–4*c*), in which the coil spring 4 is partially relaxed. Further cable slackness cannot be removed after this.

FIGS. 5*a*–5*b* show a variant of the above-described embodiment of the invention. In this case the flat coil spring 40 provides the required displacement force to the slide 23. The outer attachment of the flat coil spring 40 engages the support 42, which is connected with the slide 23, while the spring end located on the inside is attached to the slitted peg 130 of the cable drum 13. In the loaded state the radially extending slit 131, which starts at the cable drum wall 132, makes possible wedging of the slide 23 in an analog manner.

FIGS. 6*a*–6*b* represent an embodiment of the invention which ensures the compensation of the cable by means of an increase of the diameter of the outer cable drum wall (winding surface). The base body of the cable drum 11 has a slit segment 120 essentially extending in a circumferential direction and enlarged into a hollow chamber toward the center for receiving the slide 21. The slide 21 is embodied in the form of a spring and is not attached to the cable 3 as in the previously described embodiment. Its free ends are supported on arresting steps 210 on the inner wall of the slit segment 120. The slide 21, which prestressed, presses against the wall of the cable drum which is divided by the slit 111.

If cable slackness is generated, the outer wall 112 of the cable drum 11 is not loaded and the slide 21 can move up by one or several arresting steps 210. In the process, the slide 21 further expands the cable drum 11, thereby expanding the slit 111 and the diameter or circumference of the cable drum 11 is. When the cable is loaded again, the cable drum wall is supported on the slide 21 and keeps it in its present position.

The cable drum shown in FIGS. 7*a*–7*d* has a very similar embodiment. It also has a radially extending slit 121 as well as a slit segment 120 extending in the circumferential direction, in the central area of which a pair of wedge-shaped slides 22 is disposed. When cable slackness occurs, a spring 220 attempts to push the slides 22 apart and in this way to increase the circumference of the cable drum 12. The friction or support surfaces 123, 223 between the cable drum and the slide 22 are designed in such a way that automatic locking occurs if any type of load by the cable is placed on the outer cable drum wall 122.

Figure 8A:
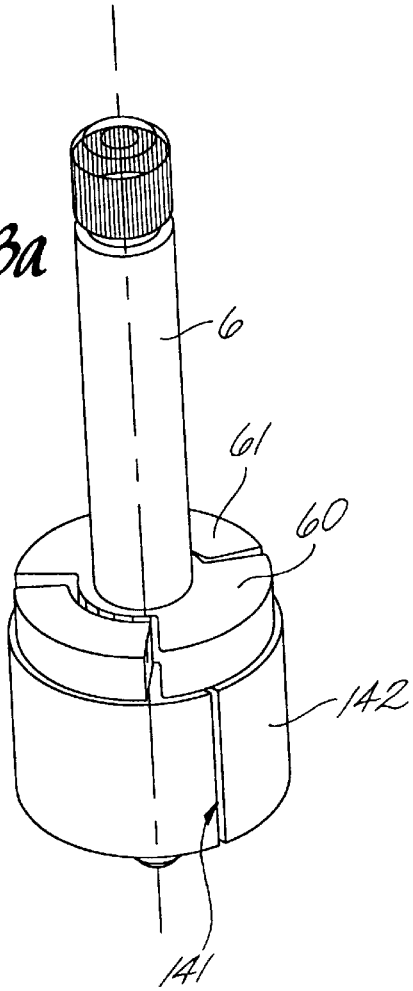
Figure 8B:
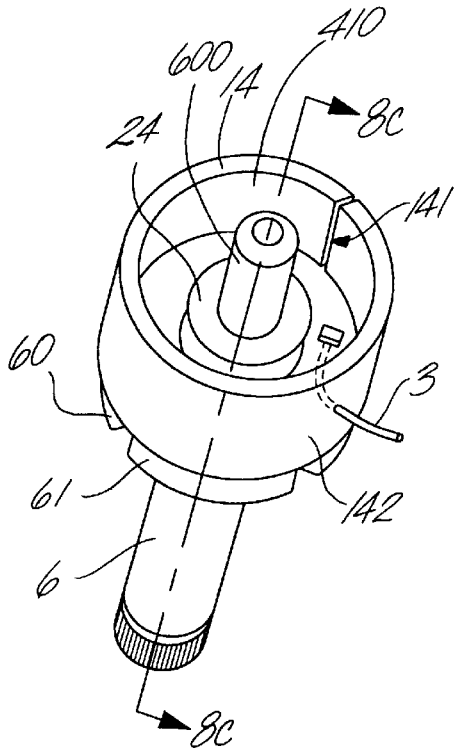
Figure 8C:
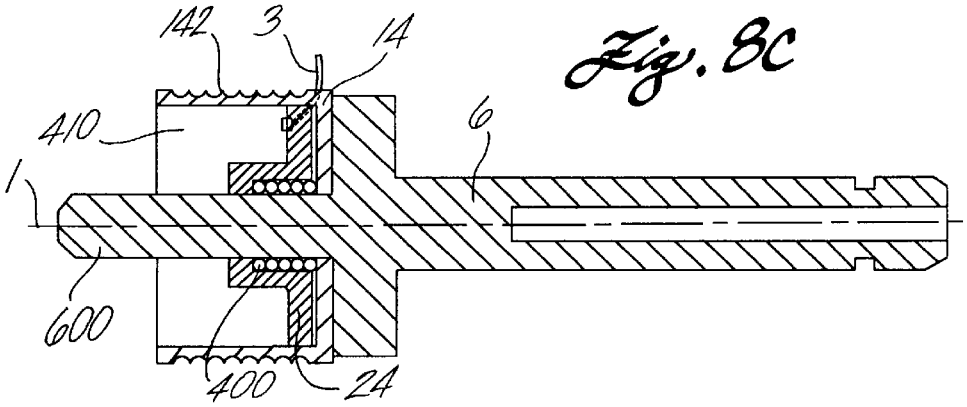

FIGS. 8*a*–8*c* show a slitted cable drum 14 in several views, which has a slide 24 axially displaceable on the peg 600 in axially-oriented guide 410 inside the cable drum 14. The required displacement force is provided by the coil spring 400, which is supported between the cable drum 14 and the slide 24. In a manner analogous to that disclosed in connection with the embodiment of FIGS. 1*a* to 4*c*, one end of the cable 3 is attached to the slide 24, which moves axially to take up cable slackness, and the slit 141 in the wall 142 of the cable drum 14 makes possible the wedging of the slide in the loaded state. Although not shown in FIGS. 8*a*–8*c*, the cable 3 is wound several times around the cable drum 14 as shown in FIGS. 1*b* and 1*c*.

The connection of the cable drum 14 to a driveshaft 6, with an interposed driving claw 60 and driven claw 61, is also schematically shown. Such an embodiment could be used to operate a manual window lifter, for example.

Figure 9C:
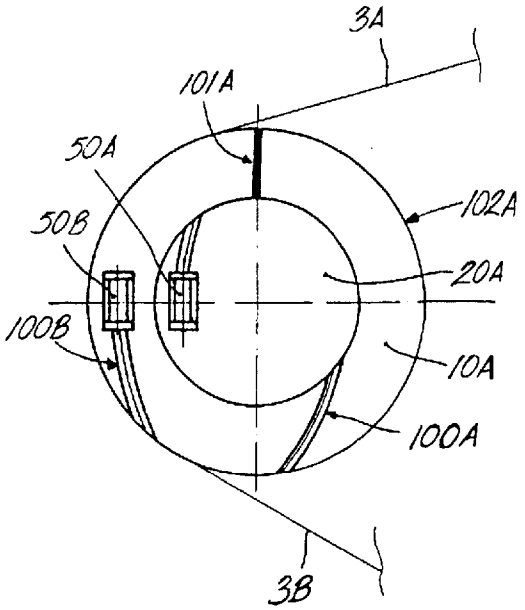
Figure 9B:
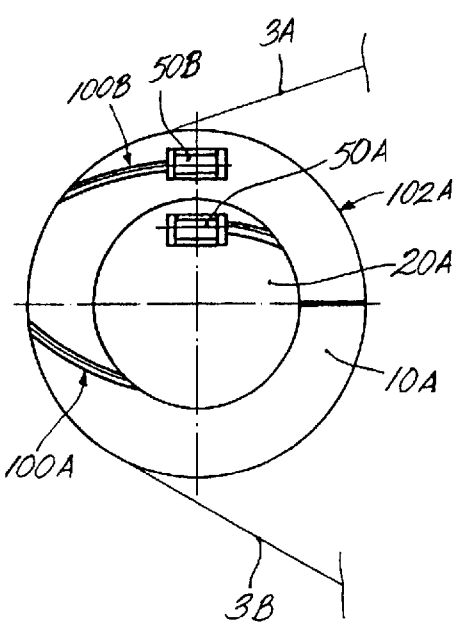
Figure 9A:
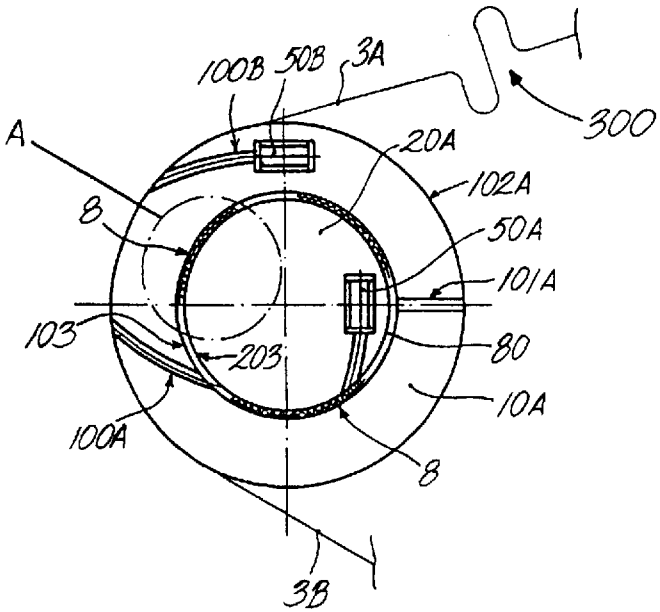
Figure 9C:
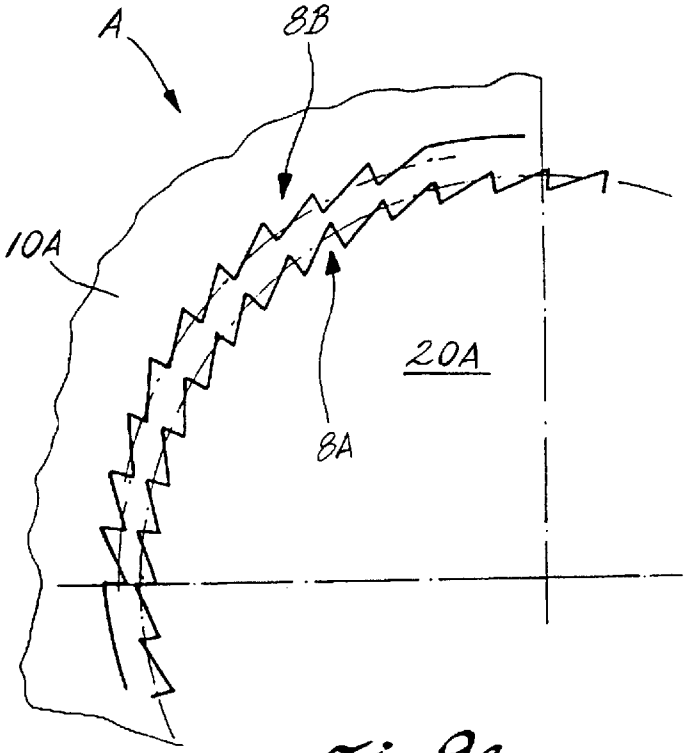
Figure 9D:
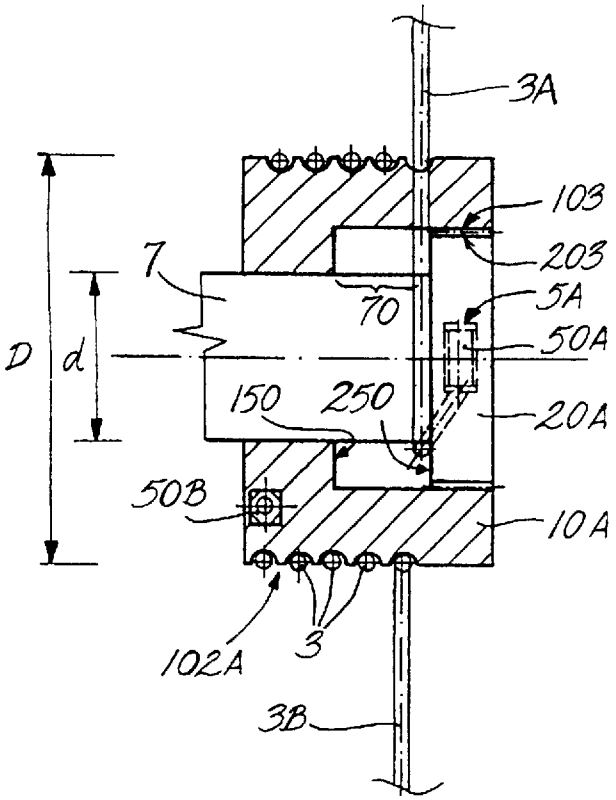

FIGS. 9*a*–9*e* show another embodiment of the invention which utilizes the drive movement to compensate the cable slackness 300. Different load phases of the cable drum of the invention are illustrated in FIGS. 9*a*, 9*b* and 9*c*. These schematic representations do not necessarily always have to correspond to the actual size relationships; they are primarily intended to make the functional principle of this embodiment clear. The axial section in FIG. 9*d* provides information regarding the simple structural design of the device of the invention.

The device accordingly consists of a cup-like cable drum 10A rotatably seated on the driveshaft 7. The hollow chamber of the cable drum is closed off by a rotatable part or winding element 20A, which is connected with the driveshaft 7 fixed against relative rotation. A cable attachment 5A (for example, a fitting chamber) is provided in this part 20A, on which a cable fitting 50A is arrested. The cable end 3A which follows this is wound around the winding area 70 located in the interior of the cable drum and reaches the outer cable drum wall 102A (winding surface) through a conduit 100A. The other cable end fastened on the cable fitting 50B is passed through the conduit 100B to the exterior of the outer cable drum wall 102A.

If the diameter (d) of the winding element is substantially 30% to substantially 70% of the diameter (D) of the cable drum 10A (see FIG. 9*d*), this ratio leads to a favorable leverage to compensate for occurring cable slackness and guarantees at the same time an optimum initial stress of the cable. Thus, an optimum relation between friction factors on the one hand and some clearance on the other hand can be achieved.

In the unloaded state, as shown in FIG. 9*a*, a gap 80 exists between the inner cable drum wall 103 and the supporting jacket surface 203 of the rotatable part 20A. To ensure a certain mobility of the jacket area, the cable drum 10A has a radially extending slit 101A, so that the inner cable drum wall 103 and the jacket surface 203 of the rotatable part 20A can be brought into engagement with each other. Preferably these surfaces 103, 203 have segments with toothing elements 8, which are evenly distributed over the circumference. A provision of the inner cable drum wall with toothing elements 8B in the form of segments is particularly advantageous, while the toothing 8A covers the entire circumference of the jacket surface 203 of the movable part 20A. In this way it is ensured that the toothing elements can dependably come into engagement with each other.

FIG. 9*e* shows in enlargement the section A from FIG. 9*a* with sawtooth-shaped toothing elements 8A, 8B each having flat and steep profiles for gliding over each other in one direction and coming into engagement in the other direction. Such toothing can be used with particular advantage, if the toothing elements are formed on the inner front surface 150 of the cable drum, with which toothing elements on the annular surface 250 of the rotatable part 20A are associated. In this embodiment of the invention, which is not illustrated, the said surfaces 150, 250 are pressed together by an axially acting spring. The corresponding winding surface is then located on the other side of the rotatable part 20A, i.e., on the other side of the winding surface 70 in FIG. 9*e*. Such toothing ensures that the drive force is dependably transmitted even when the drive force acts opposite the winding direction of the cable end 3A on the area 70.

In the lower displacement position of the window lifter, the cable end 3A is advantageously unwound from the cable drum 10A to a large extent and only a small angle of wrap (for example 90°) rests on the winding surface 102A of the cable drum 10A. At the same time the other cable end 3B (attached to the cable drum 10A) is wound on the winding surface 102A to the greatest extent. A possibly occurring cable slackness 300 (FIG. 9*d*) can be compensated particularly well under these circumstances without there being noticeable friction between the cable 3 and the cable drum 10A.

In the course of compensating the cable slackness 300 by means of a torque of the driveshaft 7 in the lifting direction, the cable end 3A guided through the conduit 100A is wound on the winding area 70, and the rotatable part 20A with the cable fitting 50A attached thereto can freely turn in the interior of the cable drum 10A provided with a slit 101A. In the process the cable drum 10A essentially pauses without rotating, so that no driving torque is transmitted by the regulating system. Thus there is a relative movement (turning) between the cable drum and the rotatable part 20A. A further relative movement of the two parts 10A, 20A is stopped only when the cable end 3A is tightened and the inner cable drum wall 103 is in engagement with the jacket surface 203, and the transmission of the drive torque to the regulating mechanism of the cable window lifter becomes possible.

The radial mobility of the two surfaces 103, 203 required for the engagement of the appropriate area of the cable drum 10A is ensured by the radially extending slit 101A. After tightening the cable end 3A (see FIG. 9*b*), the load on the winding surface 102A leads to an at least partial narrowing of the slit 101A and to contact between the surfaces 103, 203. A further turning movement of the driveshaft 7 and thus of the part 20A inevitably leads to a turning movement of the cable drum 10A (see FIG. 9*c*) and thus to the wound cable 3 being transported.

It should be noted here that the cable drum of the invention can basically function without toothing 8. In many actual uses a frictional connection between the inner cable drum wall 103 and the jacket surface 203 of the part 20A will be sufficient to attain the effect in accordance with the invention.

The disclosure of German patent applications P 44 16 979.5 and P 43 18 591.6 (attached as Appendices A and B) are incorporated by reference in this application. Priority of these applications is claimed.

While the invention has been described in detail with respect to certain preferred embodiments, it should be understood that the invention is not limited to those precise embodiments, and that those embodiments are instead representative examples of the many modifications and variations which would present themselves to those of skilled in the art without departing from the scope and spirit of this invention, as defined in the appended claims.

What is claimed is:

1. A cable drum assembly for use in cooperation with manual or electrical drive means the assembly comprising:

a cable drum having an outer radially movable cable drum wall providing a winding surface and being rotatably driven by the drive means;

a cable forming a closed cable loop and wound on the winding surface; and a part movably mounted in the drum and connected to the cable, the part being movable in the drum in a direction to take up slack in the cable loop, the cable drum and part being structured such that when the outer cable drum wall is being moved inwardly under a load exterted on the outer cable drum wall by the cable, the outer cable drum wall it causes a restraining force on the part against such movement of the part and when the outer cable drum wall is radially moved outwardly when such load is reduced such restraining force on the part is reduced thereby permitting such movement of the part.

2. The assembly according to claim 1 wherein the closed cable loop has a first end attached to said part and a second end attached to the cable drum assembly.

3. The assembly according to claim 1 wherein the cable drum wall comprises an axially extending slit thereby permitting the cable drum wall to expand and contract radially with variations in the cable load.

4. The assembly according to claim 3 comprising a resilient member acting between the cable drum and the cable loop to translate the end of the cable loop relative to the cable drum to compensate for slackness.

5. The assembly according to claim 1 comprising a winding element rotatably driven by the drive means and rotatably coupled with the part, wherein the winding element rotates the part relative to the cable drum wall in one direction to compensate for slackness.

6. A cable drum assembly having automatic cable length compensation for use in cooperation with a manual or electrical means for driving an apparatus, the assembly comprising:

a cable drum rotatably driven by the drive means and having an outer cable drum wall defining a winding surface;

a cable wound on the winding surface;

a part connected to the cable and disposed inside the cable drum and movable in relation to the outer cable drum wall; and the outer cable drum wall comprising at least one slit axially extending sufficiently to thereby permit the outer cable drum wall to expand and contract radially, the cable drum and part being structured such that expansion of the cable drum wall removes a restraining force on the part allowing the part to move and take up slack of the cable and a load exterted by the cable on the cable drum wall causes the cable drum wall to contract radially and apply a restraining force on the part which resists such movement of the part.

7. The cable drum assembly in accordance with claim 6 wherein the cable forms a cable loop and the part is connected with a first cable end of the cable and further comprises a spring for compensating for cable loop slackness, said spring acting between the cable drum and the part.

8. The cable drum assembly in accordance with claim 6 wherein the cable drum assembly comprises a guide and in which the part comprises a slide which is displaceably seated in the guide of the cable drum and which moves in the guide to compensate for the cable slackness, and wherein the slide is in contact with the outer cable drum wall.

9. The cable drum assembly in accordance with claim 8 wherein the cable forms a cable loop and the part is connected with a first cable end of the cable and the cable drum assembly further comprises a spring acting between the cable and the slide for translating the slide relative to the cable drum, thereby compensating for cable loop slackness.

10. A cable drum assembly in accordance with claim 8 comprising an attachment for the cable and in which the slide is connected to the attachment.

11. The cable drum assembly in accordance with claim 10 further comprising a coil spring, a cable attachment support for the cable and a bar for cable guidance which is provided in the guide, the bar having a front face for support of a first one end of the coil spring, a second end of the coil spring being supported on the cable attachment.

12. The cable drum assembly in accordance with claim 8 in which the at least one slit extends axially and radially inward from the outer cable drum wall as far as an inner support surface, on the cable drum, for the part, and wherein the silt permits expansion or contraction of the circumference of the outer cable drum wall.

13. The cable drum assembly in accordance with claim 12 wherein the guide extends over a guide area, and the slit is disposed in a central area of the guide area and the slide extends over more than half the guide area and over the slit, and wherein the slide is supported by the outer cable drum wall in any position of the slide.

14. The cable drum assembly in accordance with claim 12 in which the guide of the cable drum has radially directed inner and outer support surfaces, which are spaced from and can come into engagement with corresponding radially directed inner or outer support surfaces of the slide when the cable exerts radial forces on the outer cable drum wall.

15. The cable drum assembly in accordance with claim 14 comprising an axially directed support surface of the slide and an axially directed stop surface of the cable drum for engaging the support surface of the slide.

16. The cable drum assembly in accordance with claim 14 in which the slide has support surfaces and a clamping ring segment in the area of the support surfaces, which engages a corresponding clamping ring segment in a radially inward section of the cable drum.

17. The cable drum assembly in accordance with claim 8 wherein there is an opening in the winding surface of the outer cable drum wall and the apparatus has a stop position the cable passes through the opening in the winding surface of the cable drum with an angle of wrap on the winding surface of greater than approximately 45°.

18. The cable drum assembly in accordance with claim 6 wherein the cable drum assembly comprises a conduit shaped guide in which the displacement of the part takes place, the conduit shaped guide extending concentrically to an axis of rotation of the cable drum.

19. A cable drum assembly for use in cooperation with manual or electrical drive means, the assembly comprising:

a cable drum having an outer cable drum wall providing a winding surface for a cable and for being rotatably driven by the drive means; and a part in the drum for connection to such cable and urged for movement in a direction to take up slack in the cable, the cable drum and part being structured such that when the outer cable drum wall is moved inwardly under a load exterted on the outer cable drum wall by such cable the wall thereby causes a restraining force on the part inhibiting such movement of the part, and when such load is reduced the outer cable drum wall is radially moved outwardly thereby reducing such restraining force thereby permitting such movement of the part.

20. A rotatable cable drum for a closed cable loop guided over reversing rollers, the cable drum providing automatic cable length compensation, the cable drum comprising:

a radially movable outer cable drum wall having a winding surface for transporting a conduit;

a part disposed inside the cable drum in movable relationship to the outer cable drum wall, the part being connected with a first end of the cable loop so that the cable, starting at the movable part, is guided through the conduit exteriorly onto the winding surface, the cable drum and part being structured such that when a load is placed on the outer cable drum wall by the cable movement of the part is resisted; and wherein the outer cable drum wall comprises at least one slit which extends axially and radially inward from the outer cable drum wall as far as an inner support surface on the cable drum for the part, and wherein the slit permits expansion and contraction of the circumference of the outer cable drum wall.

21. The cable drum in accordance with claim 20 comprising a guide and wherein the part comprises a slide movable along the guide and wherein the guide extends over a guide area, and the at least one slit is disposed in a central area of the guide area and the slide extends over more than half the guide area and the slit, and wherein the at least one slit is supported by the outer cable drum wall in any position of the slide.

22. A rotatable cable drum for a closed cable loop guided over reversing rollers, the cable drum providing automatic cable length compensation, the cable drum comprising:

a radially movable outer cable drum wall having a winding surface for transporting a conduit;

a part disposed inside the cable drum in movable relationship to the outer cable drum wall, the part being connected with a first end of the cable loop so that the cable, starting at the movable part, is guided through the conduit exteriorly onto the winding surface, the cable drum and part being structured such that when a load is placed on the cable drum wall by the cable movement of the part is arrested; and a guide, wherein the part comprises a slide which is displaceably seated in the guide and which compensates the cable slackness by means of movement of the slide, the slide being in contact with the outer cable drum wall, the outer cable drum wall allowing displacement of the slide only when a radial force of the cable exerted on the outer cable drum wall is released.

23. The cable drum in accordance with claim 22 wherein the guide of the cable drum comprises axially directed inner and outer support surfaces, which can come into engagement with corresponding radially directed inner or outer support surfaces of the slide to allow interlocking between the respective support surfaces when the cable exerts radial forces on the outer cable drum wall.

24. The cable drum in accordance with claim 22 wherein there is a radial slit in the cable drum wall and wherein the slide engages the radial slit of the cable drum wall.

* * * * *